US012546183B2

(12) United States Patent
Gar et al.

(10) Patent No.: US 12,546,183 B2
(45) Date of Patent: Feb. 10, 2026

(54) PACKER ASSEMBLY WITH EXPANDABLE SPACER

(71) Applicant: Halliburton Energy Services, Inc., Houston, TX (US)

(72) Inventors: Shobeir Pirayeh Gar, Plano, TX (US); Frank Vinicia Acosta Villarreal, Houston, TX (US); Charles David Slavin, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 121 days.

(21) Appl. No.: 18/625,553

(22) Filed: Apr. 3, 2024

(65) Prior Publication Data

US 2025/0314145 A1 Oct. 9, 2025

(51) Int. Cl.
*E21B 33/128* (2006.01)
*E21B 33/12* (2006.01)

(52) U.S. Cl.
CPC ..... *E21B 33/128* (2013.01); *E21B 33/1208* (2013.01)

(58) Field of Classification Search
CPC .... E21B 33/128; E21B 23/06; E21B 33/1285; E21B 33/12; E21B 33/1208; E21B 33/1216; E21B 33/134
See application file for complete search history.

(56) References Cited

U.S. PATENT DOCUMENTS 4,296,806 A * 10/1981 Taylor ..... F16J 15/20 277/342
4,441,721 A * 4/1984 Harris ..... E21B 33/1208 277/342
4,697,640 A * 10/1987 Szarka ..... E21B 33/1295 166/182

(Continued)

FOREIGN PATENT DOCUMENTS

GB 2589042 A * 5/2021 ..... E21B 33/128
WO 2014200608 A1 12/2014

OTHER PUBLICATIONS

Guijun Deng et al., A Completion Technology Milestone: A HPHT Ultra-High Expansion Open-hole Packer for Multi-Stage Completions, Society of Petroleum Engineers, Oct. 2, 2019, 1-9, SPE-196044-MS, SPE, Calgary, Alberta Canada.

*Primary Examiner* — Daniel P Stephenson
(74) *Attorney, Agent, or Firm* — Sheri Higgins Law, PLLC; Sheri Higgins

(57) ABSTRACT

A packer assembly can be used to create a seal against an inside of a tubing string. The packer assembly can be used in high-temperature, high-pressure wellbores. The packer assembly can include a first and second sealing element with a spacer located between. The spacer can be made from a deformable material such that during mechanical or hydraulic actuation of the sealing elements, the spacer expands to make contact with the inside of the tubing string and keeps at least a portion of the inside edges of the sealing elements separated. The deformable spacer can reduce the amount of (Continued)

elongation strain the sealing elements commonly encounter at the vicinity of current metal spacer designs during setting below a value that would cause a loss of structural integrity to the sealing elements.

20 Claims, 5 Drawing Sheets
(2 of 5 Drawing Sheet(s) Filed in Color)

(56) References Cited

U.S. PATENT DOCUMENTS

| | | | | |
|---|---|---|---|---|
| 4,765,404 | A * | 8/1988 | Bailey | E21B 33/1295 166/134 |
| 6,827,150 | B2 | 12/2004 | Luke | |
| 6,843,315 | B2 | 1/2005 | Coronado et al. | |
| 7,708,080 | B2 * | 5/2010 | Conaway | E21B 33/1216 166/120 |
| 8,567,492 | B2 * | 10/2013 | White | E21B 33/1216 166/134 |
| 10,294,749 | B2 * | 5/2019 | Rochen | E21B 33/1216 |
| 10,633,947 | B2 * | 4/2020 | Fripp | E21B 33/128 |
| 11,248,437 | B2 * | 2/2022 | Ornelaz | E21B 33/1208 |
| 2009/0255690 | A1 * | 10/2009 | Conner | E21B 33/1216 166/387 |
| 2011/0265986 | A1 | 11/2011 | Porter et al. | |
| 2014/0014374 | A1 | 1/2014 | Yang et al. | |
| 2015/0198005 | A1 * | 7/2015 | Delzell | E21B 33/128 166/180 |
| 2016/0369586 | A1 * | 12/2016 | Morehead | E21B 33/128 |
| 2018/0023367 | A1 * | 1/2018 | Stair | E21B 33/1285 166/387 |
| 2018/0087346 | A1 | 3/2018 | Rochen | |
| 2021/0079756 | A1 * | 3/2021 | Ornelaz | E21B 33/1293 |
| 2021/0230965 | A1 * | 7/2021 | Zhong | E21B 33/13 |
| 2023/0340854 | A1 | 10/2023 | Fripp et al. | |
| 2024/0209251 | A1 * | 6/2024 | Fripp | C09K 8/426 |
| 2025/0034961 | A1 * | 1/2025 | Bhudolia | E21B 33/1208 |

* cited by examiner

PACKER ASSEMBLY WITH EXPANDABLE SPACER

TECHNICAL FIELD

A packer assembly can be used to create a seal within a casing string or tubing string in a wellbore. The packer assembly can include two sealing elements with a spacer disposed between the sealing elements. The spacer can be deformable such that the spacer expands radially away from a packer mandrel and contacts the inside of the casing string or tubing string.

BRIEF DESCRIPTION OF THE FIGURES

The features and advantages of the various embodiments will be more readily appreciated when considered in conjunction with the accompanying figures. The figures are not to be construed as limiting any of the embodiments. The patent or application file contains at least one drawing executed in color. Copies of this patent or patent application publication with color drawing(s) will be provided by the Office upon request and payment of the necessary fee.

DETAILED DESCRIPTION

Figure 1:
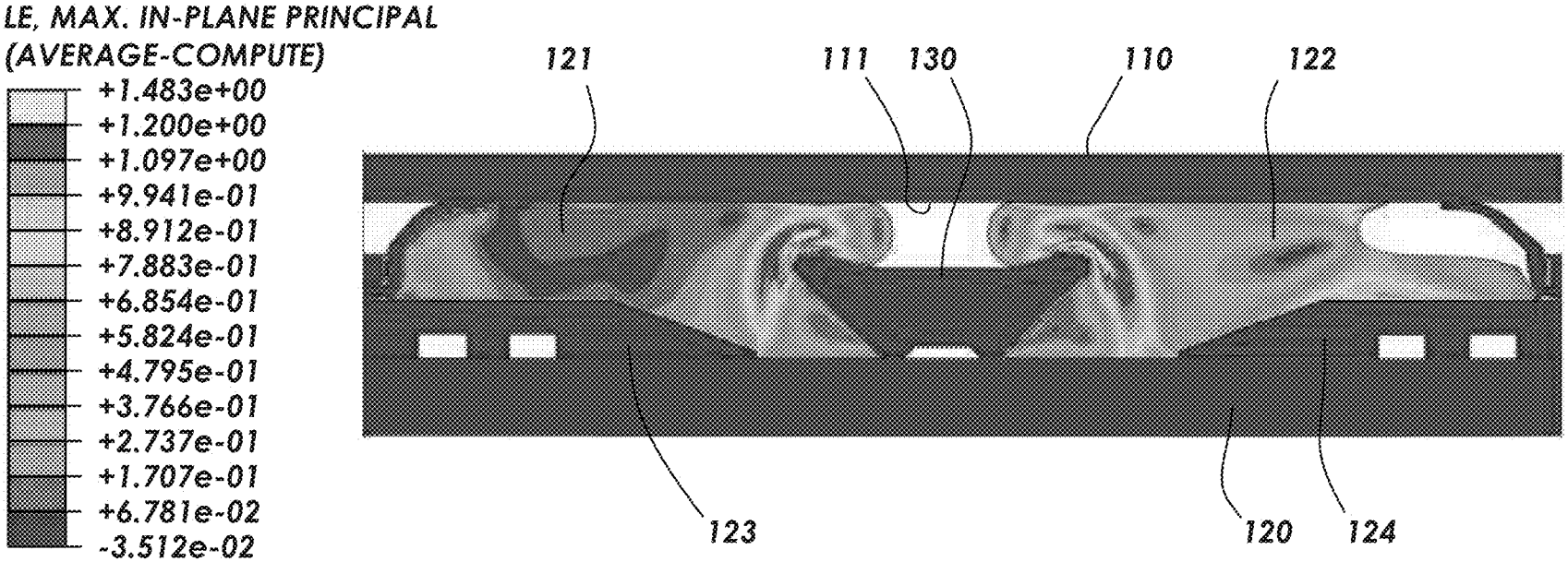
FIG. 1 is a strain model of current packer assemblies showing undesirable strain of packer sealing elements with a metal spacer in high pressure environments.

Oil and gas hydrocarbons are naturally occurring in some subterranean formations. In the oil and gas industry, a subterranean formation containing oil and/or gas is referred to as a reservoir. A reservoir can be located under land or offshore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir. The oil, gas, or water produced from a reservoir is called a reservoir fluid.

A well can include, without limitation, an oil, gas, or water production well, an injection well, or a geothermal well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. As used herein, "into a wellbore" means and includes into any portion of the well.

A portion of a wellbore can be an open hole or cased hole. In an open-hole wellbore portion, a tubing string can be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include but are not limited to the space between the wellbore and the outside of a tubing string in an open-hole wellbore, the space between the wellbore and the outside of a casing in a cased-hole wellbore, the space between the inside of a tubing string and the outside of a downhole tool, and the space between the inside of a casing and the outside of a tubing string in a cased-hole wellbore. It is to be understood that reference to a "tubing string" includes a casing string.

A variety of wellbore tools are used in oil and gas operations. The wellbore tools can be run in on a tubing string to perform a variety of functions. The wellbore tools can include one or more sealing elements. By way of example, a sealing element can be used to seal a portion of an annulus. A packer assembly can be used to seal an inside of a tubing string. The packer assembly can be run into the inside of a tubing string to seal the annulus located between the outside of the packer mandrel and the inside of the tubing string. The packer assembly can be used in multistage cementing operations whereby a cement composition can be pumped through flow ports and into the annulus. The packer can include one or more sealing elements that seal to the inside of the tubing string to isolate a portion of the annulus. The sealing elements of the packer assembly can be used to place the cement into a desired annulus area, for example, by preventing the cement from flowing past the sealing elements into undesirable annulus areas. Once the cement is placed into the desired annulus area, then the cement can set and allow for production of oil, gas, or water in a controlled manner.

Packer sealing elements can be mechanically set, hydraulically set, or hydrostatically set. As used herein, the term "set" and all grammatical variations thereof means the act of causing the packer assembly to be permanently or retrievably fixed at a desired location within a tubing string-generally by movement of one or more tool components radially away from an inner mandrel and into contact with an inner diameter of the tubing string.

Setting of the packer energizes the sealing elements to expand away from the outside of the mandrel to engage with the inside of a tubing string. The packer sealing elements are constrained on the top and bottom such that during setting, the sealing elements are forced outward in a direction away from the mandrel. Mechanical actuation uses a setting sleeve to apply the compressive force needed to deploy the element and slips. A hydraulic packer has an internal setting piston that is hydraulically actuated to apply the compression to energize the sealing element and slips. A hydrostatic set packer has an atmospheric chamber that collapses with well hydrostatic pressure to supply the compressive forces needed to set the packer.

All of these types of packers have a sealing element that is a ring of elastomeric material with the entirety of the inner diameter of the sealing element fitted onto the outside of a mandrel. The sealing element is generally constrained on the top and bottom such that actuation of the packer axially squeezes the sealing element to cause radial expansion of the sealing element and seals the annulus. Some packer assemblies have two sealing elements with a spacer disposed between them. The spacer can be used to keep both sealing elements separated from each other and constrains the inside edges of the sealing elements; thus, allowing the sealing elements to properly extrude outwardly away from the mandrel and towards the inside of the tubing string. Backup shoes can be used to constrain the outside edges of the sealing elements. The spacer forces the sealing elements outwardly away from the mandrel instead of towards each other to get a good seal and also transfers the load to the deploy the backup shoes.

Most sealing elements are made from an elastomer material that is capable of elastically stretching and can impart structural integrity to the seal created. However, wide temperature fluctuations can decrease the seal integrity of the sealing element by causing small thermal cracks in the elastomer material, by decreasing the contact stress at the sealing surface when temperature drops, or by degrading the tensile strength of the elastomer material. This can compromise the seal whereby pressure is no longer maintained and/or fluid can bypass the seal. An especially problematic wellbore environment that can cause a loss in structural integrity is a high-temperature, high-pressure (HTHP) wellbore (i.e., temperatures of 300° F. (149° C.) or higher and pressures of 10,000 pounds force per square inch "psi" (68.9 megapascals "MPa" or greater).

Some packer assemblies include a single sealing element disposed around the outside of a mandrel. Other packer assemblies can include two sealing elements with a spacer located between the sealing elements. These types of arrangements have some advantages over assemblies having only a single sealing element. Some of the advantages include the second sealing element provides a backup seal in the event the first sealing element does not form a good seal against the inside of the tubing string, or if surface cracks propagate through the entire element resulting in loss of one element's sealing capability. Furthermore, a two-piece element has empirically been shown to have a more reliable and robust setting performance over a single-piece element with less risk of the element going over the shoe during the setting process.

FIG. 1 is a strain model of current designs that include a spacer 130 made of a pure metal or metal alloy and 2 sealing elements 121/122 under a high-pressure differential of 12,000 psi (82.7 MPa). Elongation strain is the ratio between the amount of deformation or how much an object is stretched and the original length of the material before a force is applied and is reported as a percentage. The total amount of force the elastomeric sealing elements will experience during the load-and-pressure envelope is a combination of the nominal differential pressure exerted from the fluid, such as the cement composition, as it is being pumped and the axial load effects that is transferred to the sealing elements from the mandrel during setting. The elongation capacity of a sealing element is dependent on the type of the elastomeric material, but the common practice is to keep the element strain below 100%, particularly at elevated temperatures. As can be seen in FIG. 1, the inside edges of the two sealing elements expand over the top portion of the metal spacer and exhibit elongation strain around 120% in the dark red areas. At these high pressures, the local damage of the rubber at the vicinity of the metal spacer becomes unavoidable and could result in a loss of seal integrity especially at pressure reversals. Accordingly, this example of HTHP environments of current designs produced an unacceptably high elongation strain at one or more areas of the two sealing elements, which causes a loss of structural integrity at these areas and poses one of the biggest problems with current designs. However, mitigating such a high localized strain cannot be effectively addressed simply by modifying the geometry of the metal spacer. Thus, there is a long-felt need for improved packer assemblies that solve the aforementioned problems.

It has been discovered that a packer assembly can include a spacer that is deformable. The deformable spacer can be used to fully eliminate or avoid large rubber strain demands (>100%) and possibility of extrusion at the interface of a metal spacer. These designs can utilize sealing elements made from materials in current use without the need to find new materials for the sealing elements and increase the pressure rating and robustness of the packer for HTHP applications.

According to any of the embodiments, a well system can include: a wellbore that penetrates a subterranean formation; a tubing string disposed within the wellbore; and a packer assembly located within the tubing string, wherein the packer assembly comprises: a mandrel; a first sealing element disposed circumferentially around the mandrel having an inside edge and an outside edge; a second sealing element disposed circumferentially around the mandrel having an inside edge and an outside edge, wherein the first sealing element and the second sealing element are mechanically actuated to expand radially away from the mandrel and sealingly engage with an inside of the tubing string; and a spacer located between the inside edge of the first sealing element and the inside edge of the second sealing element, wherein the spacer is made from a deformable material, and wherein after deformation, a top portion of the spacer contacts the inside of the tubing string.

According to any of the embodiments, a method of creating a seal within a wellbore can include introducing the packer assembly into a tubing string disposed within the wellbore, and mechanically actuating the first sealing element and the second sealing element to expand radially away from the mandrel and create a seal against the inside of the tubing string.

The various disclosed embodiments apply to the systems, methods, and apparatuses without the need to repeat the various embodiments throughout. As used herein, any reference to the unit "gallons" means U.S. gallons.

Turning to the figures, the well system includes a wellbore that penetrates a subterranean formation. The wellbore can be located onshore or offshore. The wellbore can include straight, curved, or branched sections. The wellbore can be a vertical wellbore, horizontal wellbore, or combinations of vertical and horizontal. A tubing string 110 is disposed within the wellbore. As mentioned above, the tubing string 110 can be a casing string. A cementing operation using the packer assembly 100 can be performed in one or more locations within the wellbore, for example, a single stage cementing operation or a multistage cementing operation. According to any of the embodiments, the packer assembly 100 is used in a high-temperature, high-pressure (HTHP) wellbore—that is a wellbore having a bottomhole temperature greater than or equal to 300° F. (148.9° C.) and a pressure greater than or equal to 10,000 psi (68.9 MPa). As used herein, the term "bottomhole" in this context refers to the temperature and pressure at the location of the packer assembly 100. It is to be understood that the pressure can be the total pressure differential exerted on the packer assembly due to the nominal differential pressure exerted from a fluid, such as the cement composition, as it is being pumped into the tubing string, and the axial load effects that is transferred to the sealing elements from the mandrel during setting. According to any of the embodiments, the packer assembly 100 is used in a high-pressure wellbore having a bottomhole pressure of 10,000 psi (68.9 MPa) or greater and a bottomhole temperature less than 300° F. (148.9° C.)—that is, the packer assembly can be used in a high-pressure wellbore without high temperatures.

Figure 2A:
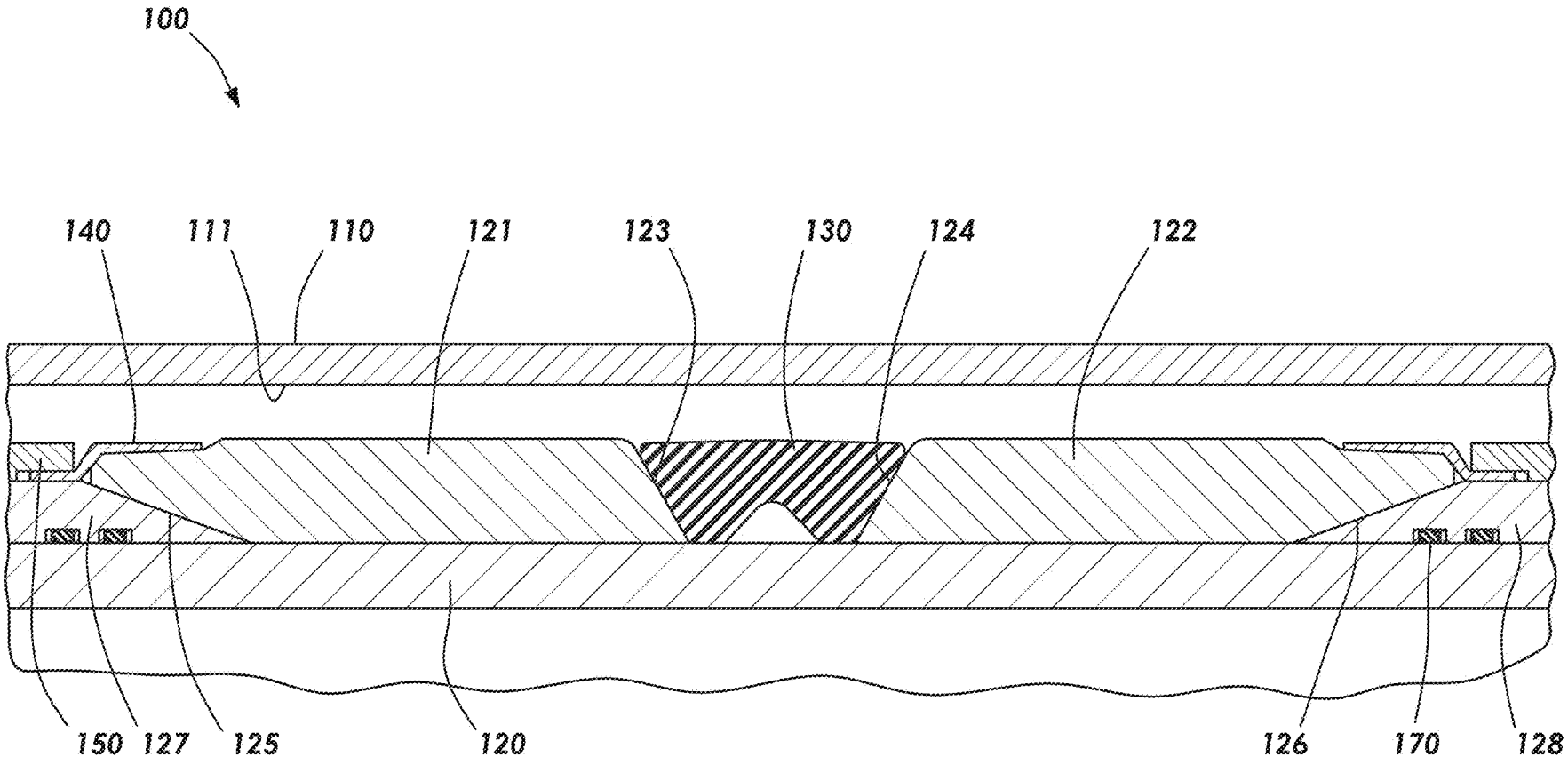
FIG. 2A is a cross-sectional view of a packer assembly before setting showing a deformable spacer according to certain embodiments.
Figure 3A:
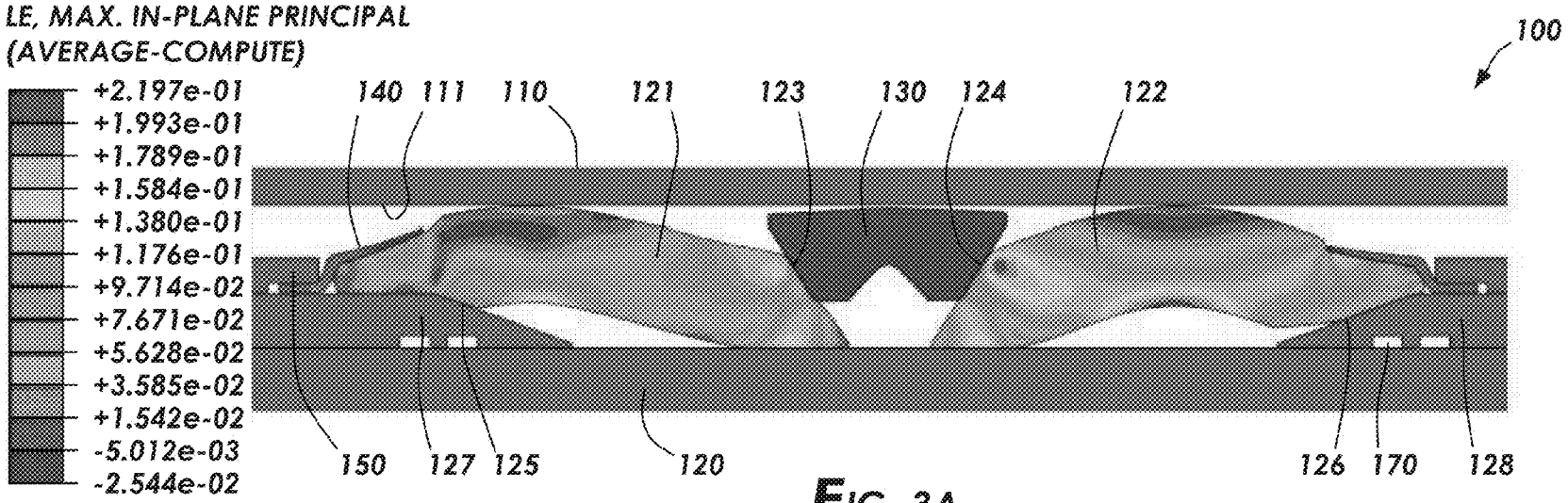
FIGS. 3A and 3B are strain models of the packer assembly of FIG. 2A during setting and after fully setting, respectively, according to certain embodiments.
Figure 3B:
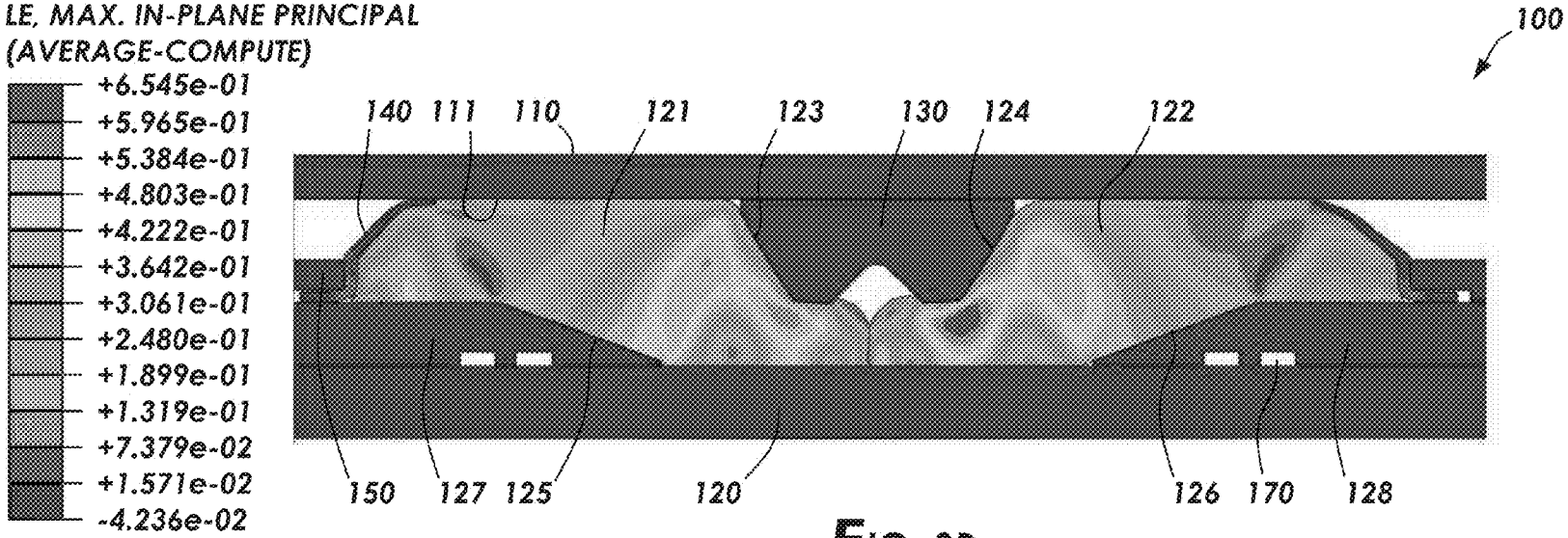

With reference to FIG. 2A, the packer assembly 100 includes a mandrel 120. A first sealing element 121 and a second sealing element 122 are disposed circumferentially around the mandrel 120. The first sealing element 121 includes an inside edge 123 and an outside edge 125. The second sealing element 122 includes an inside edge 124 and an outside edge 126. The first sealing element 121 and the second sealing element 122 are mechanically or hydraulically actuated to expand radially away from the mandrel 120 and sealingly engage with an inside 111 of the tubing string 110, for example as shown in FIGS. 3A, 3B, and 4B.

The first and second sealing elements 121/122 can be made from any type of material that can expand when a force is applied during mechanical or hydraulic actuation. The first and second sealing elements 121/122 can be made from an elastomer material. As used herein, the term "elastomer" means a natural or synthetic polymer having elastic properties. The elastomer material can have a desired durometer. Durometer or also known as Shore durometer is a standardized way to measure the hardness of materials like rubber (elastomers) and plastics and is a dimensionless measurement. Durometer measurement scales range from 0 to 100. Durometer numbers simply represent a relative comparison of hardness between different but similar materials that have had their hardness measured using the same durometer scale, device, and measurement standard. Generally, an elastomer having a higher durometer is harder than a lower durometer elastomer. For example, a 90 durometer polyurethane material is harder than a different polyurethane material having a 70 durometer. According to any of the embodiments, the elastomer material for the first and second sealing elements 121/122 has a durometer in a range of 70 to 90. The elastomer material can have a durometer sufficient to maintain structural integrity in HTHP or HP wellbores.

Polymers commonly include amorphous regions and crystalline regions. A polymer is a large molecule composed of repeating units, typically connected by covalent chemical bonds. A polymer is formed from monomers. During the formation of the polymer, some chemical groups can be lost from each monomer. The piece of the monomer that is incorporated into the polymer is known as the repeating unit or monomer residue. The backbone of the polymer is the continuous link between the monomer residues. The polymer can also contain functional groups or side chains connected to the backbone at various locations along the backbone. Polymer nomenclature is generally based upon the type of monomer residues comprising the polymer. A polymer formed from one type of monomer residue is called a homopolymer. A copolymer is formed from two or more different types of monomer residues. The number of repeating units of a polymer is referred to as the chain length of the polymer. The number of repeating units of a polymer can range from approximately 11 to greater than 10,000. In a copolymer, the repeating units from each of the monomer residues can be arranged in various manners along the polymer chain. For example, the repeating units can be random, alternating, periodic, or block. The conditions of the polymerization reaction can be adjusted to help control the average number of repeating units (the average chain length) of the polymer. As used herein, a "polymer" can include a cross-linked polymer. As used herein, a "cross link" or "cross linking" is a connection between two or more polymer molecules. A cross-link between two or more polymer molecules can be formed by a direct interaction between the polymer molecules, or conventionally, by using a cross-linking agent that reacts with the polymer molecules to link the polymer molecules.

A polymer has an average molecular weight, which is directly related to the average chain length of the polymer. For a copolymer, each of the monomers will be repeated a certain number of times (number of repeating units). The average molecular weight for a copolymer can be expressed as follows:

$$\text{Avg.molecular weight}=(\text{M.W.}m_1*\text{RU}m_1)+(\text{M.W.}m_2*\text{RU}m_2)\ldots$$

where $\text{M.W.m}_1$ is the molecular weight of the first monomer; $\text{RU m}_1$ is the number of repeating units of the first monomer; $\text{M.W.m}_2$ is the molecular weight of the second monomer; and $\text{RU m}_2$ is the number of repeating units of the second monomer. Of course, a terpolymer would include three monomers, a tetra polymer would include four monomers, and so on.

The elastomer can be a non-reactive polymer or a degradable polymer. Non-limiting examples of non-reactive polymers include nitrile rubber, hydrogenated nitrile rubber (HNBR), a fluorocarbon-based fluoroelastomer rubber containing vinylidene fluoride as a monomer such as FKM or FFKM rubbers, or natural rubber.

Degradable polymers include polymers that dissolve in a wellbore fluid. Non-limiting examples of degradable polymers include urethane, polyurethane rubber, polyether-based rubber, polyester-based rubber, polylactic acid-based polymers, polyglycolic acid-based polymers, polyvinyl alcohol-based polymers, and thiol-based polymers.

The packer assembly 100 includes a spacer located between the inside edge 123 of the first sealing element 121 and the inside edge 124 of the second sealing element 122. The spacer 130 is made from a deformable material. The deformable material can be selected such that the spacer material expands when the setting force is applied. According to any of the embodiments, the material for the spacer 130 does not comprise a metal or metal alloy. This is because metals and metal alloys are not capable of deforming and thus expanding the necessary amount as discussed below. The spacer can have edges that are angled away from a middle of the spacer. The angle, formed with the initial side located along the outside of the inner mandrel and the terminal side being the edges of the spacer 130, can be greater than 90°, for example in a range of 100° to 145°. The inside edges 123/124 of the first and second sealing elements 121/122 can have an angle in relation to the outside of the inner mandrel that matches the angle of the edges of the spacer 130. In this manner, there is not a gap between the edges of the spacer and the inside edges of the sealing elements.

According to any of the embodiments, the spacer material is more rigid or stiff compared to the material for the first and second sealing elements 121/122. By way of example, the spacer material can have a durometer greater than the durometer of the material for the first and second sealing elements 121/122. The higher durometer can be, for example, a spacer 130 material having a durometer that is in a range of 5% to 50% greater than the durometer of the first and second sealing elements 121/122 material. In this manner, the spacer 130 can constrain the inside edge 123 of the first sealing element 121 and the inside edge 124 of the second sealing element 122 during setting. Without being made of a more rigid or stiffer material, then during setting, the first and second sealing elements 121/122 may not adequately expand to form a proper seal against the inner diameter or inside 111 of the tubing string 110. According to any of the embodiments, the material for the first and second sealing elements 121/122 is a rubber, and the material for the spacer 130 is a thermoplastic. The spacer 130 material can have a durometer in a range of 50 to 90. The material for the spacer 130 can also be expressed in terms of elastic modulus. According to any of the embodiments, the spacer 130 material has an elastic modulus in a range of 0.3 to 5 gigapascals (GPa). For comparison and as way of another illustration of why metals or metal alloys are not suitable for use as the spacer material, typical metals have an elastic modulus in the range of 45 to 407 GPa. According to any of the embodiments, the elastomer material for the first and second sealing elements 121/122 and the spacer 130 material have a minimum durometer for use in HTHP wellbores. By way of example, the minimum durometer can be 40. The minimum durometer can ensure that structural integrity is maintained even when used in wellbore have a high temperature (i.e., greater than or equal to 300° F. (148.9° C.).

The spacer 130 material can be a thermoplastic polymer. The thermoplastic polymer can be, without limitation, acrylic polymers, thermoset polyesters (PE), polypropylene (PP), nylon, polyvinyl chloride (PVC), poly-(butylene terephthalate) (PBT), polycarbonate (PC), poliestireno (PS), polyetheretherketone (PEEK), low-density polyethylene (LDPE), poly-(ethylene terephthalate) (PET), poly-(methyl methacrylate) (PMMA), and combinations thereof.

Figure 4A:
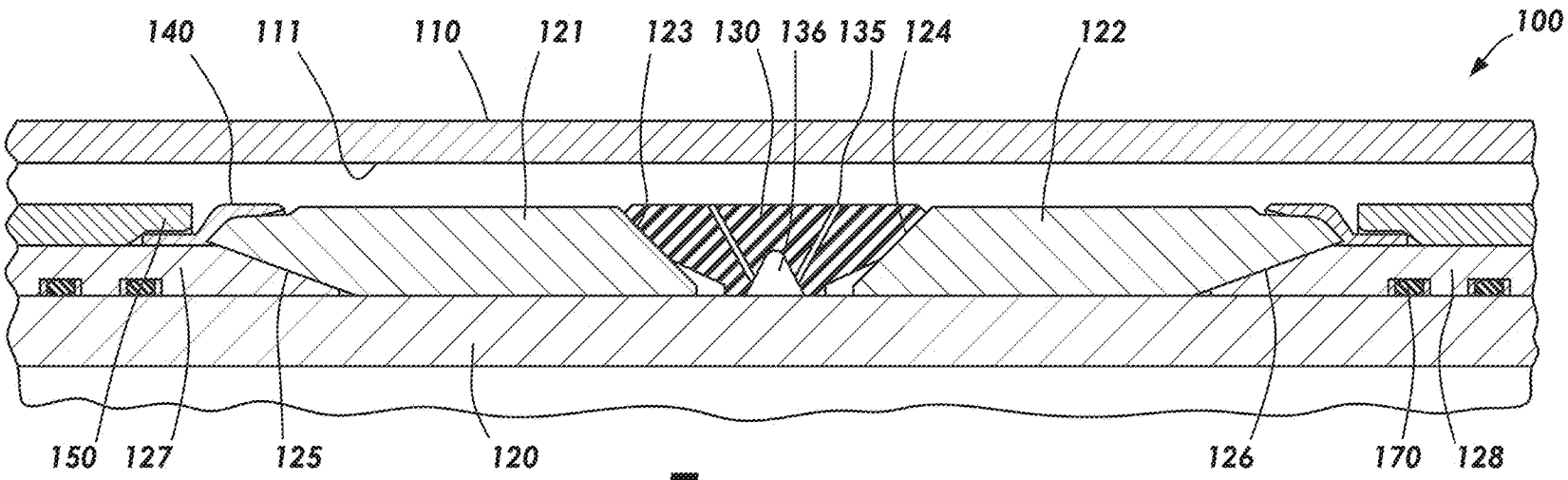
FIGS. 4A and 4B are cross-sectional views of a packer assembly before and after setting, respectively, having a deformable spacer according to certain other embodiments.
Figure 4B:
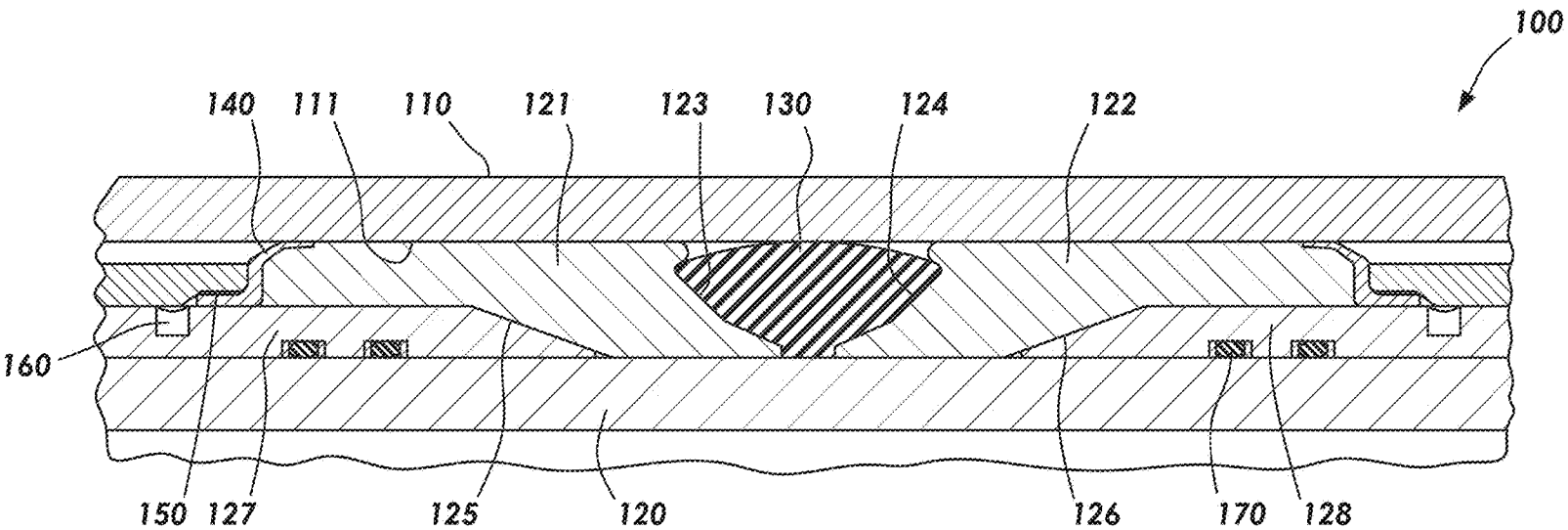

FIGS. 2A and 4A show the packer assembly after being installed within the tubing string 110 and prior to setting. In the pre-set configuration, the first and second sealing elements 121/122 can each have a length ranging from 3 to 10 inches (7.6 to 25.4 cm). FIG. 3A shows the first and second sealing elements 121/122 as the packer is being set due to mechanical actuation; and FIGS. 3B and 4B show the packer assembly after being fully set. As shown, the first and second sealing elements 121/122 can be constrained on the inside and outside edges 123/124/125/126 via the spacer 130, backup shoes 140, and cover sleeve 150. After mechanical actuation a seal is created against the inside 111 of the tubing string 110 and prevents fluid flow around the first and second sealing elements 121/122. The first and second sealing elements 121/122 can be energized through mechanical or hydraulic compression, and according to some of the embodiments, does not swell in a swelling fluid. According to any of the embodiments, the first and second sealing elements 121/122 create a seal through compression of the sealing elements between two surfaces being the outside of the mandrel 120 and the inside 111 of the tubing string 110 with compressive loads exceeding 500 psi (3.45 MPa) for example. The seal created can form a bi-directional seal wherein the sealing elements can hold pressure in two directions, for example above and below the seal. According to any of the embodiments, the sealing element is capable of bi-directionally holding pressures up to 10,000 psi (68.95 MPa) or greater.

Figure 2B:
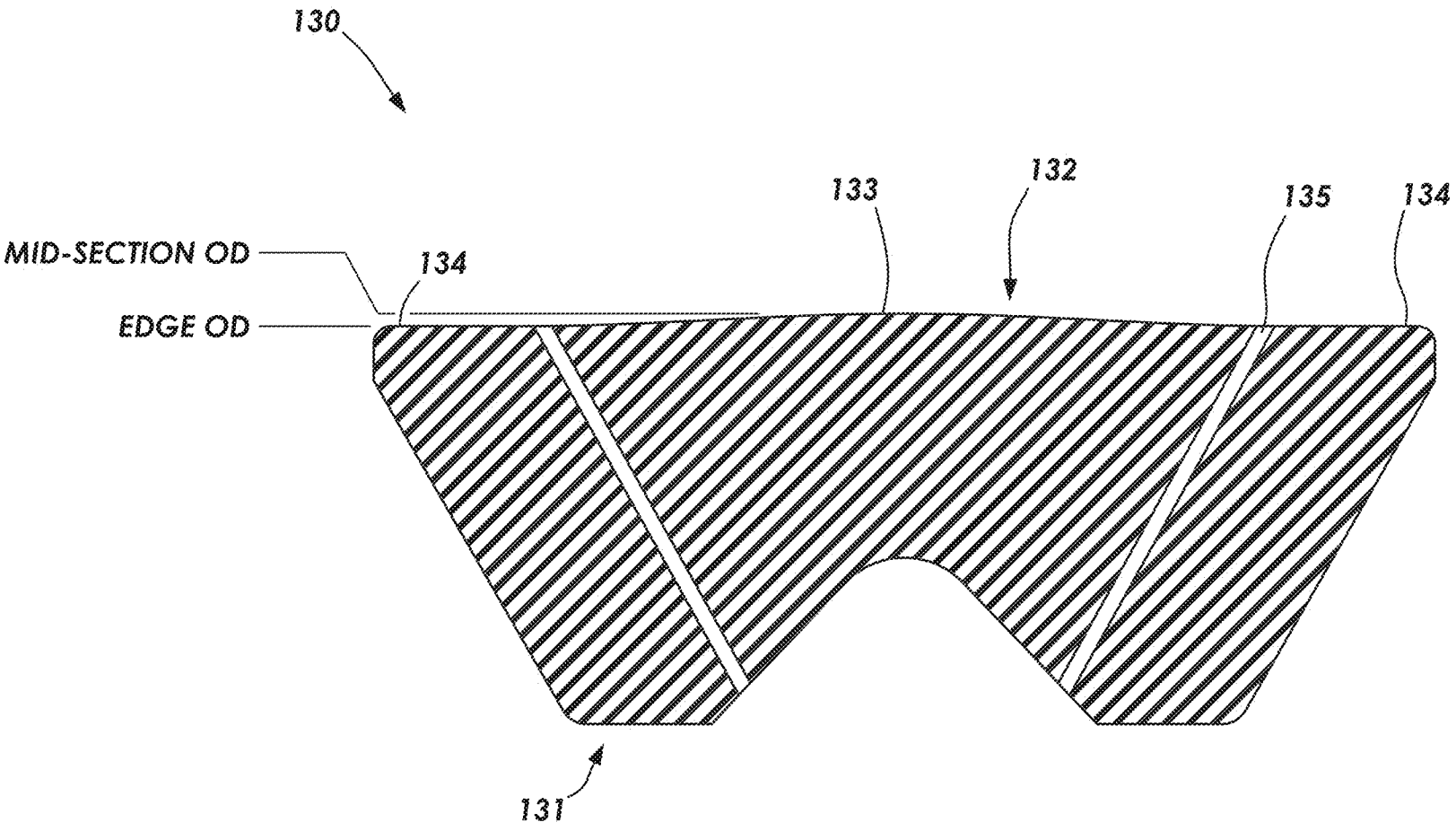
FIG. 2B is an enlarged cross-sectional view of the deformable spacer according to certain embodiments.

FIG. 2B is a cross-sectional view of the spacer 130 according to certain embodiments. The spacer 130 includes a bottom portion 131, a top portion 132, a middle portion 133, and edges 134. The methods include mechanically or hydraulically actuating the first and second sealing elements 121/122 to expand radially away from the mandrel 120 and create a seal against the inside 111 of the tubing string 110. The backup shoes 140 can be attached to the cover sleeve 150, and the cover sleeve 150 can be temporarily connected to a first element prop 127 and a second element prop 128 via a frangible device 160 as shown in FIG. 4B. The first element prop 127 can be temporarily connected to the mandrel 120 via another frangible device (not shown). The second element prop 128 can be permanently connected to the mandrel 120. The frangible device 160 can be any device that is capable of withstanding a predetermined amount of force and capable of releasing at a force above the predetermined amount of force. The frangible device 160 can be, for example, a shear pin, a shear screw, a shear ring, a load ring, a lock ring, a rupture disk, a pin, or a lug. There can also be more than one frangible device 160 that connects the cover sleeve 150 to the props 127/128. The frangible device 160 or multiple frangible devices can be selected based on the force rating of the device, the total number of devices used, and the predetermined amount of force needed to release the device. The force rating for the frangible device 160 for the cover sleeve 150 can be greater than the frangible device (not shown) for the first element prop 127. In this manner, the frangible device for the first element prop can shear before the frangible device 160 for the cover sleeve 150.

As can be seen in FIGS. 3A, 3B, and 4B, setting of the packer is initiated and then fully set. During actuation, once the force applied to the first element prop 127, the cover sleeve 150, and the backup shoes 140 exceeds the force rating of the frangible device connecting the first element prop 127 to the mandrel 120, the frangible device shears and the cover sleeve 150, backup shoes 140, and first element prop 127 can move towards each other. The outside edges 125/126 of the first and second sealing elements 121/122 begin to be forced over and on top of the ramped surfaces of the first and second element props 127/128. With continued force being applied, the frangible device 160 for the cover sleeve 150 can shear, which allows the first and second element props 127/128 to move even closer together towards each other in relation to the cover sleeve 150 and backup shoes 140. This actuation causes the first and second sealing elements 121/122 and the spacer 130 to deform and expand and move radially away from the mandrel 120 towards the inside 111 of the tubing string 110 to create a seal against the inside 111 of the tubing string 110.

As can also be seen, in FIG. 2A the bottom portion 131 of the spacer 130 is very close to or touching the outside of the mandrel 120, but during the mechanical actuation as shown in FIGS. 3A and 3B, the entire spacer 130 can not only deform and expand away from the mandrel but can also move radially away from the outside of the mandrel such that the bottom portion 131 is no longer close to or touching the outside of the mandrel.

Referring back to FIG. 2B, the middle portion 133 of the spacer 130 can be higher than the edges 134 such that the spacer curves down on both sides away from the middle portion 133. During actuation as shown in FIG. 3A, the curved design enables the middle portion 133 of the spacer 130 to first contact the inside 111 of the tubing string 110 before the edges 134 make contact. This feature advantageously forces any fluid that could become trapped between the outer diameter of the spacer and the inside of the tubing string out away from the interface and optionally past the first and second sealing elements 121/122 such that no fluid exists at the interface between the sealing elements and spacer and the inside of the tubing string. This feature also helps to ensure that a tight seal is created. The spacer 130 can also include one or more fluid escape holes 135 that span completely through the spacer material from the top portion 132 to the bottom portion 131, for example as shown in FIG. 2B. The fluid escape holes 135 can provide a flow path whereby any fluid, whether it be a liquid or a gas, flows from the open area at the bottom portion 131 through the spacer material and out the top portion 132. The fluid escape holes 135 also serve as pressure relief holes so pressure is not trapped underneath the spacer next to the outside of the mandrel 120, which if trapped, could impair the functionality of the spacer 130.

After deformation, the top portion 132 of the spacer 130 contacts the inside 111 of the tubing string 110. With continued actuation, for example, as shown in FIG. 3B, the entire top portion 132 of the spacer 130, which now includes the edges 134, can contact the inside 111 of the tubing string 110. The spacer 130 can also deform and expand towards the mandrel 120. A portion of the inside edges 123/124 of the first and second sealing elements 121/122 can be deformed and be pushed underneath the bottom portion 131 of the spacer 130 to fill a space between the bottom portion 131 and the outside of the mandrel 120. The strain modeling depicted in FIGS. 3A and 3B show that while there is elongation strain of the sealing elements, the maximum elongation strain placed on the sealing elements is approximately 65.4%, which is much less than the maximum allowable strain of 120% to ensure structural integrity. This clearly demonstrates that with a metal spacer as shown with the strain modeling in FIG. 1 wherein the sealing elements exhibited an elongation strain of 120%, the novel use of the deformable spacer reduces the elongation strain well below 100% as shown in the strain modeling in FIG. 3B. Accordingly, when the packer is eventually fully set, the pressure rating of the packer will be governed by the strength of the backup system and not by the strain on the sealing elements adjacent to the metal spacer.

FIGS. 4A and 4B show the spacer 130 according to other embodiments. As can be seen in the pre-set configuration shown in FIG. 4A, an extrusion gap 136 can exist at the bottom portion 131 of the spacer 130. During actuation, the areas of the spacer on either side of the extrusion gap 136 can be deformed and expand towards each other and when the packer assembly 100 is fully set as shown in FIG. 4B, the extrusion gap 136 can be wholly or partially filled in with the spacer material. As with the spacer 130 depicted in FIGS. 2A-3B, the middle portion 133 of the spacer 130 is first to contact the inside 111 of the tubing string 110. The edges 134 of the spacer 130 may or may not contact the inside 111 of the tubing string 110 after being fully set. One difference to note is that the bottom portion 131 of the spacer 130 depicted in FIGS. 4A and 4B may not displace from contact with the outside of the mandrel 120 after setting as was illustrated for the other spacer embodiment depicted in FIG. 3B for example. Accordingly, the fluid escape holes 135 may be crucial for this spacer embodiment such that no fluid or pressure is trapped within the extrusion gap 136 during actuation, which could inhibit or prevent the spacer material from completely filling in the extrusion gap 136; and thus, could inhibit or prevent the top portion 132 of the spacer 130 from fully contacting the inside 111 of the tubing string 110. Accordingly, the spacer 130 in this embodiment can expand radially away from the mandrel instead of expanding and displacing away from the mandrel.

An embodiment of the present disclosure is a well system having a wellbore that penetrates a subterranean formation comprising: a tubing string disposed within the wellbore; and a packer assembly located within the tubing string, wherein the packer assembly comprises: a mandrel; a first sealing element disposed circumferentially around the mandrel having an inside edge and an outside edge; a second sealing element disposed circumferentially around the mandrel having an inside edge and an outside edge, wherein the first sealing element and the second sealing element are mechanically or hydraulically actuated to expand radially away from the mandrel and sealingly engage with an inside of the tubing string; and a spacer located between the inside edge of the first sealing element and the inside edge of the second sealing element, wherein the spacer is made from a deformable material, and wherein after deformation, a top portion of the spacer contacts the inside of the tubing string. Optionally, the wellbore has a bottomhole pressure greater than or equal to 10,000 psi (68.9 MPa). Optionally, the wellbore has a bottomhole temperature greater than or equal to 300° F. (148.9° C.). Optionally, the first and second sealing elements are made from a material having a durometer in a range of 70 to 90. Optionally, the first and second sealing elements comprise an elastomer material. Optionally, the elastomer material is selected from the group consisting of a non-reactive polymer, a degradable polymer, and combinations thereof. Optionally, the non-reactive polymers are selected from the group consisting of nitrile rubber, hydrogenated nitrile rubber (HNBR), a fluorocarbon-based fluoroelastomer rubber containing vinylidene fluoride as a monomer selected from FKM or FFKM rubbers, natural rubber, and combinations thereof. Optionally, the degradable polymers are selected from the group consisting of urethane, polyurethane rubber, polyether-based rubber, polyester-based rubber, polylactic acid-based polymers, polyglycolic acid-based polymers, polyvinyl alcohol-based polymers, thiol-based polymers, and combinations thereof. Optionally, the spacer is made from a material having a durometer greater than a durometer of a material for the first and second sealing elements. Optionally, the durometer of the material for the spacer is in a range of 5% to 50% greater than the durometer of the material for the first and second sealing elements. Optionally, the spacer is made from a material having an elastic modulus in a range of 0.3 to 5 gigapascals. Optionally, the spacer is made from a thermoplastic polymer. Optionally, the thermoplastic polymer is selected from the group consisting of acrylic polymers, thermoset polyesters (PE), polypropylene (PP), nylon, polyvinyl chloride (PVC), poly-(butylene terephthalate) (PBT), polycarbonate (PC), poliestireno (PS), polyetheretherketone (PEEK), low-density polyethylene (LDPE), poly-(ethylene terephthalate) (PET), poly-(methyl methacrylate) (PMMA), and combinations thereof. Optionally, prior to the mechanical or hydraulic actuation, a bottom portion of the spacer is located adjacent to an outside of the mandrel; and wherein after the actuation, the bottom portion of the spacer moves radially away from the outside of the mandrel such that the bottom portion is no longer adjacent to the outside of the mandrel. Optionally, the top portion of the spacer comprises a middle portion and edges, and wherein the middle portion is higher than the edges such that the spacer curves down on both sides away from the middle portion. Optionally, the spacer comprises one or more fluid escape holes that span completely through the spacer material thickness from the top portion to a bottom portion. Optionally, a maximum elongation strain placed on any portion of the first and second sealing elements during the mechanical or hydraulic actuation is less than 100%. Optionally, an extrusion gap exists between a bottom portion of the spacer and an outside of the mandrel prior to the mechanical or hydraulic actuation; wherein during actuation, areas of a spacer material on either side of the extrusion gap are deformed and expand towards each other; and wherein when the packer assembly is fully set, the extrusion gap is wholly or partially filled in with the spacer material.

Another embodiment of the present disclosure is a method of creating a seal within a wellbore comprising: introducing a packer assembly into a tubing string disposed within the wellbore, wherein the packer assembly comprises: a mandrel; a first sealing element disposed circumferentially around the mandrel having an inside edge and an outside edge; a second sealing element disposed circumferentially around the mandrel having an inside edge and an outside edge; and a spacer located between the inside edge of the first sealing element and the inside edge of the second sealing element, wherein the spacer is made from a deformable material, and wherein after deformation, a top portion of the spacer contacts an inside of the tubing string; and mechanically or hydraulically actuating the first sealing element and the second sealing element to expand radially away from the mandrel and create a seal against the inside of the tubing string. Optionally, the wellbore has a bottomhole pressure greater than or equal to 10,000 psi (68.9 MPa). Optionally, the wellbore has a bottomhole temperature greater than or equal to 300° F. (148.9° C.). Optionally, the first and second sealing elements are made from a material having a durometer in a range of 70 to 90. Optionally, the first and second sealing elements comprise an elastomer material. Optionally, the elastomer material is selected from the group consisting of a non-reactive polymer, a degradable polymer, and combinations thereof. Optionally, the non-reactive polymers are selected from the group consisting of nitrile rubber, hydrogenated nitrile rubber (HNBR), a fluorocarbon-based fluoroelastomer rubber containing vinylidene fluoride as a monomer selected from FKM or FFKM rubbers, natural rubber, and combinations thereof. Optionally, the degradable polymers are selected from the group consisting of urethane, polyurethane rubber, polyether-based rubber, polyester-based rubber, polylactic acid-based polymers, polyglycolic acid-based polymers, polyvinyl alcohol-based polymers, thiol-based polymers, and combinations thereof. Optionally, the spacer is made from a material having a durometer greater than a durometer of a material for the first and second sealing elements. Optionally, the durometer of the material for the spacer is in a range of 5% to 50% greater than the durometer of the material for the first and second sealing elements. Optionally, the spacer is made from a material having an elastic modulus in a range of 0.3 to 5 gigapascals. Optionally, the spacer is made from a thermoplastic polymer. Optionally, the thermoplastic polymer is selected from the group consisting of acrylic polymers, thermoset polyesters (PE), polypropylene (PP), nylon, polyvinyl chloride (PVC), poly-(butylene terephthalate) (PBT), polycarbonate (PC), poliestireno (PS), polyetheretherketone (PEEK), low-density polyethylene (LDPE), poly-(ethylene terephthalate) (PET), poly-(methyl methacrylate) (PMMA), and combinations thereof. Optionally, prior to the mechanical or hydraulic actuation, a bottom portion of the spacer is located adjacent to an outside of the mandrel; and wherein after the actuation, the bottom portion of the spacer moves radially away from the outside of the mandrel such that the bottom portion is no longer adjacent to the outside of the mandrel. Optionally, the top portion of the spacer comprises a middle portion and edges, and wherein the middle portion is higher than the edges such that the spacer curves down on both sides away from the middle portion. Optionally, the spacer comprises one or more fluid escape holes that span completely through the spacer material thickness from the top portion to a bottom portion. Optionally, a maximum elongation strain placed on any portion of the first and second sealing elements during the mechanical or hydraulic actuation is less than 100%. Optionally, an extrusion gap exists between a bottom portion of the spacer and an outside of the mandrel prior to the mechanical or hydraulic actuation; wherein during actuation, areas of a spacer material on either side of the extrusion gap are deformed and expand towards each other; and wherein when the packer assembly is fully set, the extrusion gap is wholly or partially filled in with the spacer material.

Therefore, the various embodiments are well adapted to attain the ends and advantages mentioned as well as those that are inherent therein. The particular embodiments disclosed above are illustrative only, as the various embodiments may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention.

As used herein, the words "comprise," "have," "include," and all grammatical variations thereof are each intended to have an open, non-limiting meaning that does not exclude additional elements or steps. While compositions, systems, and methods are described in terms of "comprising," "containing," or "including" various components or steps, the compositions, systems, and methods also can "consist essentially of" or "consist of" the various components and steps. It should also be understood that, as used herein, "first," "second," and "third," are assigned arbitrarily and are merely intended to differentiate between two or more sealing elements, props, edges, etc., as the case may be, and do not indicate any sequence. Furthermore, it is to be understood that the mere use of the word "first" does not require that there be any "second," and the mere use of the word "second" does not require that there be any "third," etc.

Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent(s) or other documents that may be incorporated herein by reference, the definitions that are consistent with this specification should be adopted.

What is claimed is:

1. A well system having a wellbore that penetrates a subterranean formation comprising:

a tubing string disposed within the wellbore; and a packer assembly located within the tubing string, wherein the packer assembly comprises:

a mandrel;

a first sealing element disposed circumferentially around the mandrel having an inside edge and an outside edge;

a second sealing element disposed circumferentially around the mandrel having an inside edge and an outside edge, wherein the first sealing element and the second sealing element are mechanically or hydraulically actuated to expand radially away from the mandrel and sealingly engage with an inside of the tubing string; and a spacer located between the inside edge of the first sealing element and the inside edge of the second sealing element, wherein the spacer is made from a deformable material, and wherein after deformation, a top portion of the spacer contacts the inside of the tubing string, wherein a portion of the inside edges of the first and second sealing elements are deformed and pushed underneath a bottom portion of the spacer after the mechanical or hydraulic actuation.

2. The well system according to claim 1, wherein the wellbore has a bottomhole pressure greater than or equal to 10,000 psi (68.9 MPa).

3. The well system according to claim 2, wherein the wellbore has a bottomhole temperature greater than or equal to 300° F. (148.9° C.).

4. The well system according to claim 1, wherein the first and second sealing elements are made from a material having a durometer in a range of 70 to 90.

5. The well system according to claim 1, wherein the first and second sealing elements comprise an elastomer material.

6. The well system according to claim 5, wherein the elastomer material is selected from the group consisting of a non-reactive polymer, a degradable polymer, and combinations thereof.

7. The well system according to claim 6, wherein the non-reactive polymers are selected from the group consisting of nitrile rubber, hydrogenated nitrile rubber (HNBR), a fluorocarbon-based fluoroelastomer rubber containing vinylidene fluoride as a monomer selected from fluoroelastomer rubber (FKM) or perfluoroelastomer rubber (FFKM), natural rubber, and combinations thereof.

8. The well system according to claim 6, wherein the degradable polymers are selected from the group consisting of urethane, polyurethane rubber, polyether-based rubber, polyester-based rubber, polylactic acid-based polymers, polyglycolic acid-based polymers, polyvinyl alcohol-based polymers, thiol-based polymers, and combinations thereof.

9. The well system according to claim 1, wherein the spacer is made from a material having a durometer greater than a durometer of a material for the first and second sealing elements.

10. The well system according to claim 9, wherein the durometer of the material for the spacer is in a range of 5% to 50% greater than the durometer of the material for the first and second sealing elements.

11. The well system according to claim 1, wherein the spacer is made from a material having an elastic modulus in a range of 0.3 to 5 gigapascals.

12. The well system according to claim 1, wherein the spacer is made from a thermoplastic polymer.

13. The well system according to claim 12, wherein the thermoplastic polymer is selected from the group consisting of acrylic polymers, thermoset polyesters (PE), polypropylene (PP), nylon, polyvinyl chloride (PVC), poly-(butylene terephthalate) (PBT), polycarbonate (PC), poliestireno (PS), polyetheretherketone (PEEK), low-density polyethylene (LDPE), poly-(ethylene terephthalate) (PET), poly-(methyl methacrylate) (PMMA), and combinations thereof.

14. The well system according to claim 1, wherein prior to the mechanical or hydraulic actuation, a bottom portion of the spacer is located adjacent to an outside of the mandrel; and wherein after the actuation, the bottom portion of the spacer moves radially away from the outside of the mandrel such that the bottom portion is no longer adjacent to the outside of the mandrel.

15. The well system according to claim 1, wherein the top portion of the spacer comprises a middle portion and edges, and wherein the middle portion is higher than the edges such that the spacer curves down on both sides away from the middle portion.

16. The well system according to claim 1, wherein the spacer comprises one or more fluid escape holes that span completely through the spacer material thickness from the top portion to a bottom portion.

17. The well system according to claim 1, wherein a maximum elongation strain placed on any portion of the first and second sealing elements during the mechanical or hydraulic actuation is less than 100%.

18. The well system according to claim 1, wherein an extrusion gap exists between a bottom portion of the spacer and an outside of the mandrel prior to the mechanical or hydraulic actuation; wherein during actuation, areas of a spacer material on either side of the extrusion gap are deformed and expand towards each other; and wherein when the packer assembly is fully set, the extrusion gap is wholly or partially filled in with the spacer material.

19. A method of creating a seal within a wellbore comprising:

introducing a packer assembly into a tubing string disposed within the wellbore, wherein the packer assembly comprises:

a mandrel;

a first sealing element disposed circumferentially around the mandrel having an inside edge and an outside edge;

a second sealing element disposed circumferentially around the mandrel having an inside edge and an outside edge; and a spacer located between the inside edge of the first sealing element and the inside edge of the second sealing element, wherein the spacer is made from a deformable material, and wherein after deformation, a top portion of the spacer contacts an inside of the tubing string; and mechanically or hydraulically actuating the first sealing element and the second sealing element to expand radially away from the mandrel and create a seal against the inside of the tubing string, wherein a portion of the inside edges of the first and second sealing elements are deformed and pushed underneath a bottom portion of the spacer after the mechanical or hydraulic actuation.

20. The method according to claim 19, wherein a maximum elongation strain placed on any portion of the first and second sealing elements during the mechanical or hydraulic actuation is less than 100%.

* * * * *